US009605455B2

(12) United States Patent
Kamin et al.

(10) Patent No.: US 9,605,455 B2
(45) Date of Patent: Mar. 28, 2017

(54) COMBINATION SLAM LATCH AND CAM LOCK ADAPTER

(71) Applicant: CompX International Inc., Greenville, SC (US)

(72) Inventors: John Y. Kamin, Taylors, SC (US); Robert E. Dalton, Jr., Greenville, SC (US)

(73) Assignee: CompX International Inc., Greenville, SC (US)

( * ) Notice: Subject to any disclaimer, the term of this patent is extended or adjusted under 35 U.S.C. 154(b) by 513 days.

(21) Appl. No.: 14/227,380

(22) Filed: Mar. 27, 2014

(65) Prior Publication Data

US 2014/0319849 A1 Oct. 30, 2014

Related U.S. Application Data

(60) Provisional application No. 61/815,461, filed on Apr. 24, 2013.

(51) Int. Cl.

| | |
|---|---|
| ***E05C 1/12*** | (2006.01) |
| ***E05C 5/00*** | (2006.01) |
| ***E05B 15/10*** | (2006.01) |
| *E05C 3/12* | (2006.01) |

(52) U.S. Cl.

CPC ..... *E05C 5/00* (2013.01); *E05B 15/102* (2013.01); *E05C 2003/126* (2013.01); *Y10T 29/49716* (2015.01); *Y10T 292/103* (2015.04); *Y10T 292/1016* (2015.04)

(58) Field of Classification Search

None

See application file for complete search history.

(56) References Cited

U.S. PATENT DOCUMENTS

| | | | | |
|---|---|---|---|---|
| 4,761,978 | A * | 8/1988 | Walla | E05B 9/086 70/367 |
| 5,657,652 | A * | 8/1997 | Martin | E05B 55/12 70/107 |
| 5,931,035 | A * | 8/1999 | Bolton | E05B 9/084 70/367 |
| 6,038,898 | A | 3/2000 | Cliff | |
| 6,474,118 | B2 | 11/2002 | Martinez | |
| 6,513,357 | B2 | 2/2003 | McCurry | |
| 6,575,503 | B1 * | 6/2003 | Johansson | E05B 5/003 292/170 |
| 7,695,031 | B2 * | 4/2010 | Jackson, Jr. | E05B 1/0038 292/169 |

(Continued)

*Primary Examiner* — Kristina Fulton
*Assistant Examiner* — Thomas Neubauer
(74) *Attorney, Agent, or Firm* — Dority & Manning, P.A.

(57) ABSTRACT

A self-contained combination latch and cam lock adapter module affixes to the rear of any lock (keyed or non-keyed) that has a requisite mating feature. The module is alignable in any of four positions (up, down, left, and right) on the back of the lock for latching in any installed position. The module allows a user to slam closed an associated door or drawer without having to rotate the lock into a locked position. The module retrofits in the field by removing and replacing an existing fixed cam. In one embodiment, a mating part is rotationally spring-loaded so that when the key or knob is turned and then released, the module automatically returns to its locked position, ready to be shut.

26 Claims, 5 Drawing Sheets

(56) References Cited

U.S. PATENT DOCUMENTS

| | | | | |
|---|---|---|---|---|
| 7,978,152 | B2 * | 7/2011 | Huang | G09G 3/001 340/463 |
| 8,234,891 | B2 | 8/2012 | Dalton, Jr. et al. | |
| 8,403,376 | B2 | 3/2013 | Greiner et al. | |
| 2007/0257773 | A1 | 11/2007 | Hill et al. | |
| 2009/0132090 | A1 | 5/2009 | Kaczmarz et al. | |
| 2009/0315342 | A1 | 12/2009 | Dalton, Jr. et al. | |
| 2011/0074543 | A1 | 3/2011 | Kaczmarz et al. | |
| 2012/0248794 | A1 | 10/2012 | Dalton, Jr. et al. | |
| 2013/0192320 | A1 * | 8/2013 | Dalton, Jr. | E05B 19/0035 70/340 |

* cited by examiner

COMBINATION SLAM LATCH AND CAM LOCK ADAPTER

PRIORITY CLAIM

This application claims the benefit of previously filed U.S. Provisional Patent Application entitled "COMBINATION SLAM LATCH AND CAM LOCK ADAPTER," assigned U.S. Ser. No. 61/815,461, filed Apr. 24, 2013, and which is incorporated herein by reference for all purposes.

FIELD OF THE DISCLOSURE

The present disclosure relates to keyed or non-keyed, mechanical or electromechanical locks in applications where it is desirable to have a lock which upon closure of the drawer or door automatically relocks itself.

BACKGROUND OF THE DISCLOSURE

In certain applications and environments the user of the lock may open and close the drawer or door many times in the course of a day. In instances where fixed cam locks or dead-bolt locks are used, it occasionally happens that the user rotates the lock back to the closed position and then slams the door or drawer shut, thereby causing damage to the cam and the furniture in which it's used. The presently disclosed subject matter addresses such situation and eliminates the risk of damage to the lock and the furniture in which it is installed.

Various patent document publications relate to lock subject matter, including cam locks and/or slam locks. For example, U.S. Pat. No. 8,403,376 is entitled "Convertible Motorized Latch" and Published US Patent Application Publication No. 2009/0315342 is entitled "Adjustable Cam for Cam Lock." Other examples include U.S. Pat. No. 8,234,891; U.S. Pat. No. 6,513,357; U.S. Pat. No. 6,474,118; U.S. Pat. No. 6,038,898; US Patent Application Publication No. 2013/0192320; US Patent Application Publication No. 2012/0248794; US Patent Application Publication No. 2011/0074543; US Patent Application Publication No. 2009/0132090; and US Patent Application Publication No. 2007/0257773. All of the foregoing examples are commonly owned with the subject application, and the complete disclosures of all such patent document publications are fully incorporated herein by reference, and for all purposes.

SUMMARY OF THE DISCLOSURE

In view of the recognized features encountered in the prior art and addressed by the presently disclosed subject matter, improved apparatus and corresponding methodology therefor have been provided for improved lock closures. More particularly, the presently disclosed subject matter relates to keyed or non-keyed, mechanical or electromechanical locks for automatic relocking upon closure of the associated drawer or door (collectively referenced as an associated enclosure).

One presently disclosed exemplary embodiment relates to an adapter module, for use with a lock having a matable driving element for use with an associated enclosure to be secured with such lock. Such an adapter module preferably comprises a housing defining a mating end thereof for matably engaging the driving element of an associated lock; an attachment element for selectively attaching such housing to an associated lock; and a slam latch element. Such slam latch element is preferably retractably supported by such housing, wherein operation of such lock permits such slam latch element to be alternately moved between latched and unlatched positions relative to an associated enclosure.

In some embodiments of such exemplary adapter module, such slam latch element may comprise a slam bolt having an inclined surface for engagement relative to an associated enclosure.

In still further alternatives of such embodiments, such adapter module may further include a resilient element with one end thereof secured relative to such housing and with the other end thereof engaging such slam bolt for urging such slam bolt in a direction outward from such housing; and at least one retention element received in such housing for limiting the extension of such slam bolt in a direction outward from such housing.

In yet other variations, in some instances such resilient element may comprise a pair of compression mounted springs, with each of such pair captured relative to such housing on one end thereof and by such slam bolt on the other end thereof; and such retention element may comprise at least one pin secured relative to such housing and positioned so as to block at a predetermined point further travel of such slam bolt in a direction outward from such housing.

For some other exemplary variations of such adapter module, such retention element may be secured relative to such slam bolt for movement therewith. For some such variations, such housing may further define channels for receiving such retention element for guiding such slam bolt as it moves in alternate directions along a direction outward from such housing, and such housing further defines mounting pins formed in such housing for capturing the ends of such springs captured by such housing; and such slam bolt may further define recessed holes for receiving the ends of such compression springs captured by such slam bolt.

In other alternatives, the mating end of such housing may comprise a geometrically shaped element complementary in shape to a matable driving element of an associated lock, for engaging same. In some such instances, such geometrically shaped element may comprise a generally square shaped opening of such housing.

Per other present exemplary alternative adapter module embodiments, such attachment element may comprise an attachment screw selectively engaging an associated lock for operatively associating such module therewith.

In other variations, a present exemplary adapter module may further include a spacer element of predetermined thickness, positioned between such housing mating end and a driving element of an associated lock, for selectively positioning such slam latch element relative to an associated enclosure.

Other present exemplary embodiments of presently disclosed subject matter relate generally to a combination slam latch and cam lock adapter module, for use with a cam lock having a matable driving element and removable cam for use with an associated enclosure to be secured with such associated lock. Such embodiments preferably include a housing defining a mating end thereof for matably engaging the driving element of an associated lock in place of a removable cam removed therefrom; an attachment screw for selectively attaching such housing to an associated lock for operatively associating such module therewith; and a slam bolt. Such slam bolt is preferably retractably supported by such housing and having an inclined surface for engagement relative to an associated enclosure for slam closure thereof, wherein operation of such associated lock permits such adapter module to be alternately moved between an unlatched position relative to an associated enclosure and a slam closed position relative to such associated enclosure.

In some present variations of the foregoing, an exemplary adapter module may further include at least one compression mounted spring, with such spring captured relative to such housing on one end thereof and by such slam bolt on the other end thereof, for urging such slam bolt in a direction outward from such housing; and at least one retention pin received relative to such housing so as to limit travel of such slam bolt in a direction outward from such housing. For some such variations, such at least one retention pin may be positioned so as to limit travel of such slam bolt at a predetermined point relative to such housing.

Per other alternative exemplary adapter modules, the housing may further define channels for guiding such slam bolt as it moves in alternate directions along a direction outward from such housing, and such housing may further define mounting pins formed in such housing for capturing the end of such spring captured by such housing; and such slam bolt may further define at least one recessed hole for receiving the end of such compression spring captured by such slam bolt.

In still other alternative adapter module exemplary arrangements, such mating end of such housing comprises a generally rectangular shaped element complementary in shape to a matable driving element of an associated lock, for engaging same.

Per yet other variations, an exemplary adapter module may further include a spacer element of predetermined thickness, positioned between such housing mating end and a driving element of an associated lock, for selectively positioning such slam bolt relative to an associated enclosure.

Those of ordinary skill in the art should understand from the complete disclosure herewith that the presently disclosed subject matter equally relates to apparatus as well as to corresponding and/or associated methodology. One exemplary embodiment of such relates to methodology for converting into a slam lock a cam lock of the type having a matable driving element and removable cam attached thereto for use with an associated enclosure to be secured with such associated lock. Such methodology preferably includes removing the removable cam from the cam lock driving element; and securing to such cam lock driving element a slam latch adapter module. Such slam latch adapter module preferably comprises a housing defining a mating end thereof for matably engaging the driving element of such associated lock; and a slam bolt retractably supported by such housing and having an inclined surface for engagement relative to an associated enclosure for slam closure thereof. Per practice of such exemplary methodology, operation of such associated lock permits such adapter module to be alternately moved between an unlatched position relative to the associated enclosure and a slam closed position relative to such associated enclosure.

Per alternatives of the foregoing, the securing step may include using an attachment screw for selectively attaching the adapter module housing to the drive element of the associated lock for operatively associating such module therewith.

In other variations, such methodology may further include providing such adapter module with at least one compression mounted spring, captured relative to such housing on one end thereof and by such slam bolt on the other end thereof, for urging such slam bolt in a direction outward from such housing; and providing such adapter module with at least one retention pin received relative to such housing so as to limit travel of such slam bolt in a direction outward from such housing. For some such variations, such at least one retention pin may be positioned so as to limit travel of such slam bolt at a predetermined point relative to such housing.

For yet other variations or such exemplary methodology, such housing may further define channels for guiding such slam bolt as it moves in alternate directions along a direction outward from such housing, and such housing may further define at least one mounting pin formed in such housing for capturing the end of such spring captured by such housing; and such slam bolt may further define at least one recessed hole for receiving the end of such compression spring captured by such slam bolt.

Per exemplary variations of the foregoing methodology, the mating end of such housing may comprise a generally rectangular shaped element complementary in shape to a generally rectangular matable driving element of the associated lock, for engaging same.

In other alternatives of such methodology, the securing step may include selectively positioning such housing relative to the matable driving element of the associated lock, so that the slam bolt is selectively positioned relative to the associated enclosure.

Variations of the foregoing exemplary methodology may further include adding a spacer element of predetermined thickness, positioned between the housing mating end and the driving element of the associated lock, for selectively positioning such slam bolt relative to an associated enclosure.

Still further alternatively, per exemplary methodology, the associated lock may comprise one of a keyed lock and a keyless lock using a handle for actuation, and/or may comprise one of a mechanical lock and an electromechanical lock.

Additional objects and advantages of the presently disclosed subject matter are set forth in, or will be apparent to, those of ordinary skill in the art from the detailed description herein. Also, it should be further appreciated that modifications and variations to the specifically illustrated, referred and discussed features, elements, and steps hereof may be practiced in various embodiments and uses of the presently disclosed subject matter without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the presently disclosed subject matter may include various combinations or configurations of presently disclosed features, steps, or elements, or their equivalents including combinations of features, parts, or steps or configurations thereof not expressly shown in the figures or stated in the detailed description of such figures. Additional embodiments of the presently disclosed subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the presently disclosed subject matter, including the best mode thereof, directed to one of ordinary skill in the art, is set forth in the specification, which makes reference to the appended figures, in which.

Figure 1:
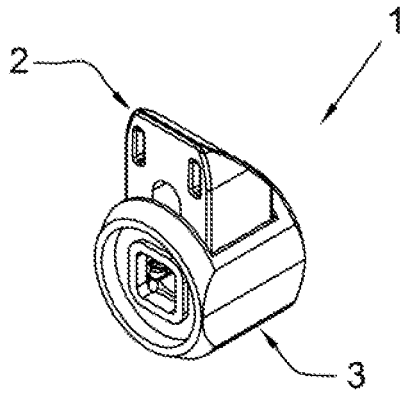
FIG. 1 is a perspective view showing an exemplary embodiment of a presently disclosed module in an assembled state.

Repeat use of reference characters throughout the present specification and appended drawings is intended to represent same or analogous features, elements, or steps of the present subject matter.

DETAILED DESCRIPTION OF THE PREFERRED EMBODIMENTS

Figure 2:
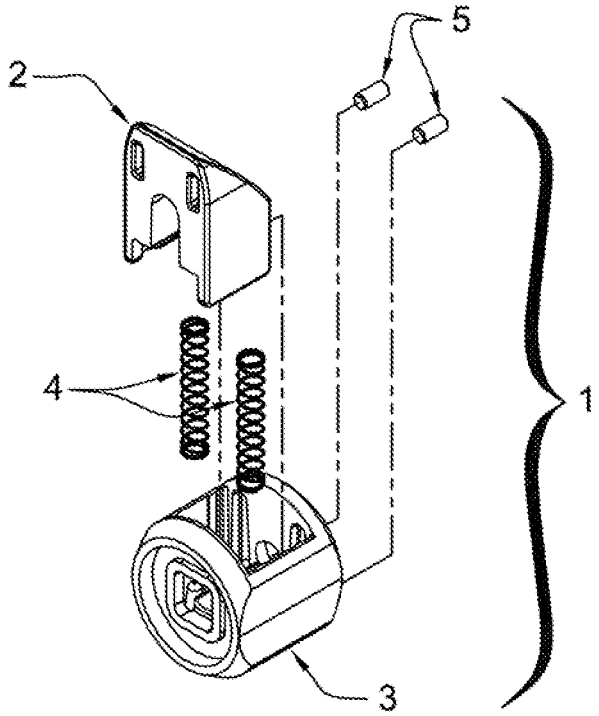
FIG. 2 is a perspective exploded view showing all of the components of the exemplary presently disclosed module.

Referring to FIG. 1, the presently disclosed module 1 consists of a slam latch element or slam bolt 2 and a housing 3. In addition, FIG. 2 shows the internal components of the presently disclosed module 1 which may include two springs or resilient elements 4 and two retention elements or pins 5. Such pins retain the bolt 2 in the housing 3.

Figure 3:
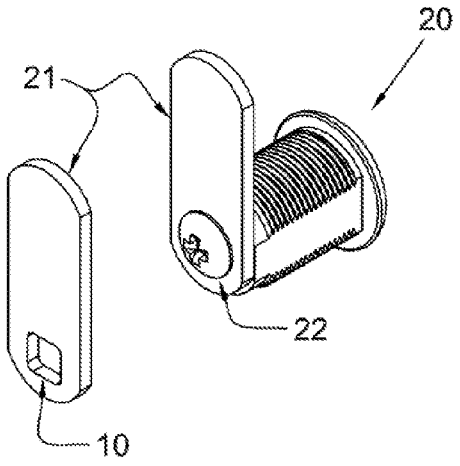
Fig. 3 (PRIOR ART)
FIG. 3 is a perspective view showing a standard (Prior Art) cam lock with an exemplary fixed cam and the fixed cam showing the square hole which adapts onto the back of the lock.
Figure 4:
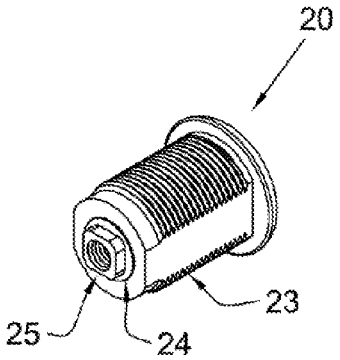
Fig. 4 (PRIOR ART)
FIG. 4 is a perspective view showing an exemplary Prior Art lock body without a cam.

FIG. 3 shows a standard (Prior Art) lock body 20 with a standard fixed cam 21 attached to lock body 20 with a screw 22. The geometrically shaped or square hole 10 in the fixed cam 21 mates with the geometrically shaped element or square pin (mating drive element) 25 shown in FIG. 4, FIG. 4 also shows the Prior Art lock body cylinder 23 and plug, or shifter in some instances 24, which are further explained in detail herein. FIG. 4 is a perspective view showing an exemplary Prior Art lock body without a cam. The square feature on the back of the lock body adapts into the square hole in the cam and a same square hole provided per present subject matter in the presently disclosed housing.

Figure 5:
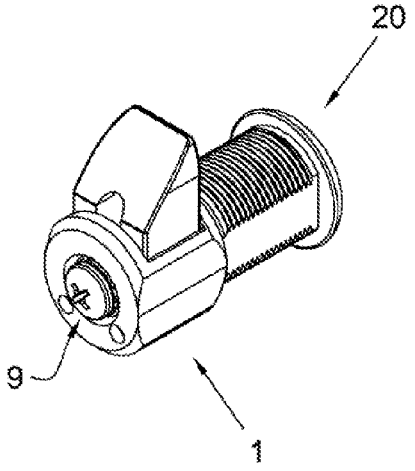
FIG. 5 is a perspective view showing the presently disclosed module adapted to the back of the exemplary Prior Art lock of FIG. 3 and FIG. 4.

FIG. 5 shows the exemplary presently disclosed module 1 installed to the back of the standard lock body 20 using representative attachment element or screw 9.

Figure 6:
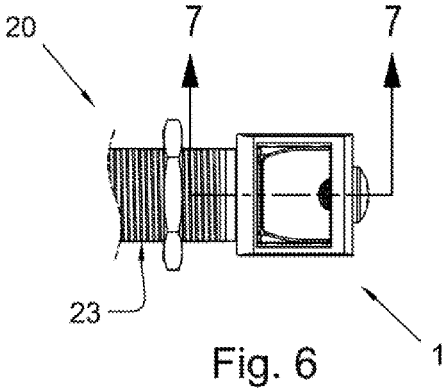
FIG. 6 is a partial top view of a presently disclosed exemplary embodiment, showing attachment thereof to the back of an existing lock body, and with an exemplary cylinder nut also shown installed onto the cylinder of such existing lock body.
Figure 7:
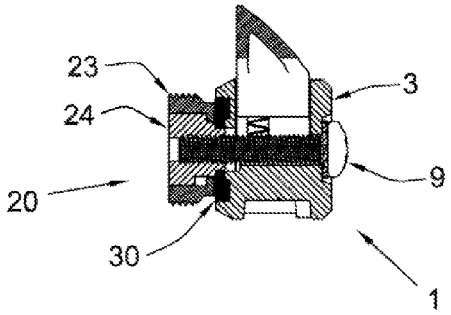
FIG. 7 is a sectional view taken along the line 7-7 in FIG. 6, and illustrating a stack of components including the exemplary presently disclosed module, an attachment screw, and an exemplary single spacer of a plurality of spacers per present subject matter allowing for different latching distances.

FIG. 6 is a top view showing the presently disclosed module 1 installed onto the back of a lock body cylinder 23. FIG. 7 is a sectional view taken through the center axis of the assembly in FIG. 6 and is showing the presently disclosed module 1 attached to the back of the lock body 20. A representative spacer 30 is positioned between the presently disclosed module 1 and lock body 20 and is interlocked with the plug/shifter 24 in the lock body cylinder 23 and on the opposite side into the housing 3. An attachment screw 9 secures the presently disclosed module 1 and spacer 30 into the back of the plug/shifter 24 which allows the presently disclosed module to be rotationally actuated, as will be understood by those of ordinary skill in the art.

Figure 8:
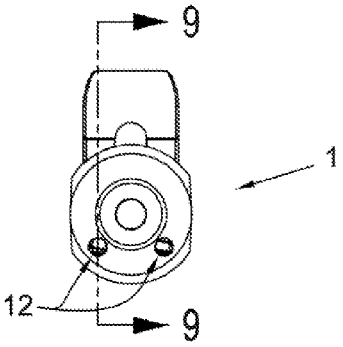
FIG. 8 is a back view of the exemplary presently disclosed module.
Figure 9:
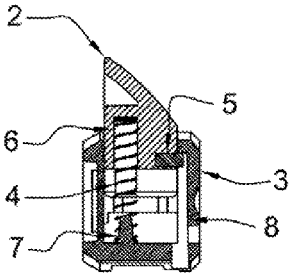
FIG. 9 is a sectional view of the presently disclosed module taken along the line 9-9 in FIG. 8, and illustrating internal components of such exemplary presently disclosed module.

FIG. 8 is an end view of the presently disclosed module 1. FIG. 9 is a sectional view taken from FIG. 8 through the center of the pin access hole 12 showing the presently disclosed installation method of the retention pin 5 in the bolt 2 which rides up and down the channels 8 in the housing 3, and showing the springs 4 which fit into holes 6 in the bolt 2 and over pins 7 in the housing 3.

Figure 10:
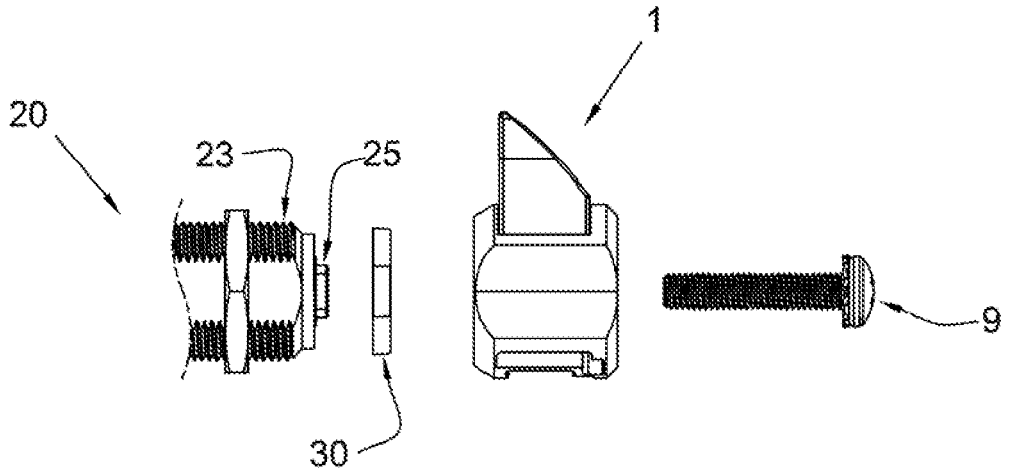
FIG. 10 is an exploded side view of presently disclosed subject matter, and representing the installation sequence (methodology) per present subject for an exemplary spacer, presently disclosed module, and attachment screw (with an understanding that optionally the presently disclosed subject matter may in some instances preferably be installed without a spacer or otherwise with varying thicknesses or dimensions of spacers)
Figure 12:
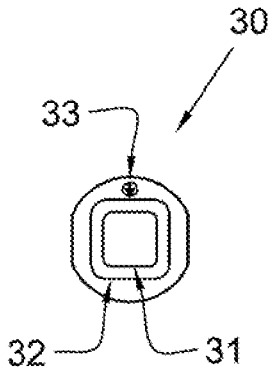
FIG. 12 is an end view of an exemplary spacer showing exemplary square drive features that interface with an existing lock body and with the presently disclosed module subject matter.
Figure 13:
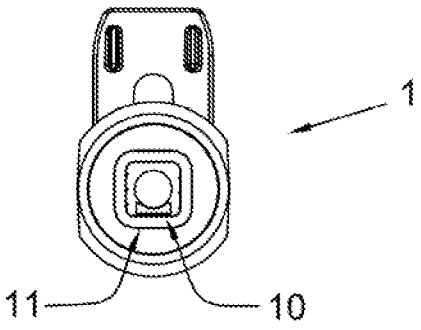
FIG. 13 is an end view of the presently disclosed module further showing square drive features that interface with an existing lock body and with the exemplary spacers.

FIG. 10 is an exploded view showing an exemplary stack-up of components, including an exemplary spacer 30, having a square hole 31 as shown in FIG. 12 which is identical in size to the square hole 10 in the fixed cam 21 for interlocking with the square pin 25 in the back of the plug/shifter 24. On the opposite end of the spacer 30, a larger square feature 32 as shown in FIG. 12 is provided and interlocks with the larger square feature 11 in the housing 3, as represented in FIG. 13.

Figure 11:
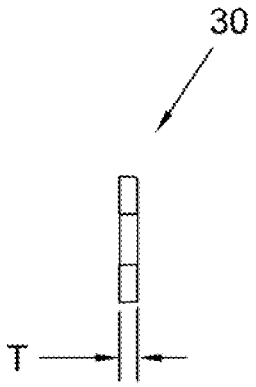
FIG. 11 is a side view of an exemplary spacer with dimension "T" being the varying thickness that allows a plurality of latching positions per presently disclosed methodology.

In a use situation where a spacer 30 is not required, the smaller square hole 10 in housing 3 (which is the identical size of the square hole 10 in the fixed cam 21) interlocks directly with the square pin 25 in the back of the plug/shifter 24, per presently disclosed subject matter. Further, per presently disclosed methodology, the thickness "T" of the spacer 30 as shown in FIG. 11 may be provided in a plurality of dimensions to facilitate variations in latching distances. As represented in FIG. 12, spacer 30 is marked at 33 with a representative dimension of 1/16 of an inch. Those of ordinary skill in the art will understand from the complete disclosure herewith that feature 33 is simply a fraction designator which may be formed, such as molded, into the plastic or other material forming spacer 30, and which indicates the thickness of a particular spacer in use. While 1/16 of an inch is represented for illustration only, other standardized or specialized dimensions (and single or plural spacers) may be practiced as needed or desired, for example, such as 1/8 of an inch, 3/16 of an inch, or 1/4 of an inch.

Figure 14:
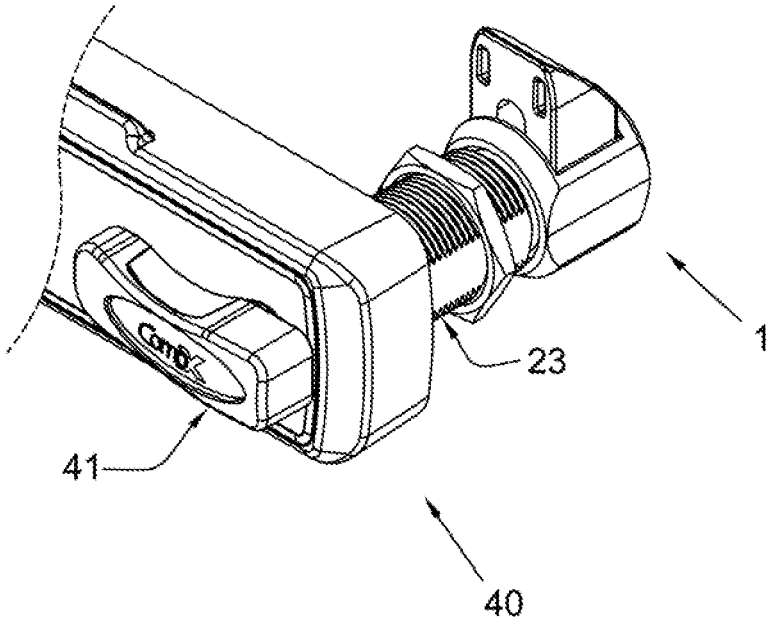
FIG. 14 is a perspective view showing an alternative embodiment of an installation of presently disclosed subject matter onto an existing electromechanical lock in conjunction with a knob rather than a key.

FIG. 14 shows a presently disclosed alternative embodiment where the presently disclosed module 1 is attached to the back to an electromechanical lock 40 and is actuated by a knob or handle 41 rather than a key. In such instance, the back of the cylinder 23 and the interlocking features are identical to a mechanical lock.

While the presently disclosed subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the presently disclosed subject matter as would be readily apparent to one of ordinary skill in the art.

What is claimed is:

1. An adapter module, for use with a lock having a matable driving element for use with an associated enclosure to be secured with such lock, comprising:

an adapter housing having a mating end for matably interfacing with an associated lock comprising a lock body cylinder rotably supporting a driving element;

an attachment element for selectively interchangeably attaching said adapter housing or a cam to the associated lock; and a slam latch element retractably supported by said adapter housing, wherein rotational operation of said lock engages said slam latch element to be alternately moved linearly between latched and unlatched positions relative to an associated enclosure.

2. An adapter module as in claim 1, wherein said slam latch element comprises a slam bolt having an inclined surface for engagement relative to an associated enclosure.

3. An adapter module as in claim 2, further including:

a resilient element with one end thereof secured relative to said housing and with the other end thereof engaging said slam bolt for urging said slam bolt in a direction outward from said housing; and at least one retention element received in said housing for limiting the extension of said slam bolt in a direction outward from said housing.

4. An adapter module as in claim 3, wherein:

said resilient element comprises a pair of compression mounted springs, with each of said pair captured relative to said housing on one end thereof and by said slam bolt on the other end thereof; and said retention element comprises at least one pin secured relative to said housing and positioned so as to block at a predetermined point further travel of said slam bolt in a direction outward from said housing.

5. An adapter module as in claim 4, wherein said retention element is secured relative to said slam bolt for movement therewith.

6. An adapter module as in claim 5, wherein:

said housing further defines channels for receiving said retention element for guiding said slam bolt as it moves in alternate directions along a direction outward from said housing, and said housing further defines mounting pins formed in said housing for capturing the ends of said springs captured by said housing; and said slam bolt further defines recessed holes for receiving the ends of said compression springs captured by said slam bolt.

7. An adapter module as in claim 1, wherein said mating end of said housing comprises a geometrically shaped element complementary in shape to a matable driving element of an associated lock, for engaging same.

8. An adapter module as in claim 7, wherein said geometrically shaped element comprises a generally square shaped opening of said housing.

9. An adapter module as in claim 1, wherein said attachment element comprises an attachment screw selectively engaging an associated lock for operatively associating said module therewith.

10. An adapter module as in claim 1, further including a spacer element of predetermined thickness, positioned between said housing mating end and a driving element of an associated lock, for selectively positioning said slam latch element relative to an associated enclosure.

11. A combination slam latch and cam lock adapter module, for use with a cam lock having a matable driving element and removable cam for use with an associated enclosure to be secured with such associated lock, comprising:

an adapter housing having a mating end for matably interfacing with an associated lock comprising a lock body cylinder rotably supporting a driving element in place of a removable cam removed therefrom;

an attachment screw for selectively interchangeably attaching said adapter housing or a cam to an associated lock driving element for operatively associating said module therewith; and a slam bolt retractably supported by said adapter housing and having an inclined surface for engagement with an associated enclosure for slam closure thereof, wherein operation of such associated lock permits said adapter module to be alternately moved linearly between an unlatched position relative to an associated enclosure and a slam closed position relative to such associated enclosure.

12. An adapter module as in claim 11, further including:

at least one compression mounted spring, with said spring captured relative to said housing on one end thereof and by said slam bolt on the other end thereof, for urging said slam bolt in a direction outward from said housing; and at least one retention pin received relative to said housing so as to limit travel of said slam bolt in a direction outward from said housing.

13. An adapter module as in claim 12, wherein:

said housing further defines channels for guiding said slam bolt as it moves in alternate directions along a direction outward from said housing, and said housing further defines mounting pins formed in said housing for capturing the end of said spring captured by said housing; and said slam bolt further defines at least one recessed hole for receiving the end of said compression spring captured by said slam bolt.

14. An adapter module as in claim 12, wherein said at least one retention pin is positioned so as to limit travel of said slam bolt at a predetermined point relative to said housing.

15. An adapter module as in claim 11, wherein said mating end of said housing comprises a generally rectangular shaped element complementary in shape to a matable driving element of an associated lock, for engaging same.

16. An adapter module as in claim 11, further including a spacer element of predetermined thickness, positioned between said housing mating end and a driving element of an associated lock, for selectively positioning said slam bolt relative to an associated enclosure.

17. Methodology for converting into a slam lock a cam lock of the type having a matable driving element and removable cam attached thereto for use with an associated enclosure to be secured with an associated lock having a lock body cylinder rotably supporting a driving element, comprising: removing the removable cam from the cam lock driving element; and securing to such cam lock driving element a slam latch adapter module comprising: an adapter housing having a mating end thereof for matably interfacing with said associated lock; and a slam bolt retractably supported by said adapter housing and having an inclined surface for engagement relative to an associated enclosure for slam closure thereof, wherein operation of such associated lock permits such adapter module to be alternately moved linearly between an unlatched position relative to the associated enclosure and a slam closed position relative to such associated enclosure.

18. Methodology as in claim 17, wherein the securing step includes using an attachment screw for selectively attaching the adapter module housing to the drive element of the associated lock for operatively associating such module therewith.

19. Methodology as in claim 17, further including:

providing such adapter module with at least one compression mounted spring, captured relative to such housing on one end thereof and by such slam bolt on the other end thereof, for urging such slam bolt in a direction outward from such housing; and providing such adapter module with at least one retention pin received relative to such housing so as to limit travel of such slam bolt in a direction outward from such housing.

20. Methodology as in claim 19, wherein:

such housing further defines channels for guiding such slam bolt as it moves in alternate directions along a direction outward from such housing, and such housing further defines at least one mounting pin formed in such housing for capturing the end of such spring captured by such housing; and such slam bolt further defines at least one recessed hole for receiving the end of such compression spring captured by such slam bolt.

21. Methodology as in claim 19, wherein said at least one retention pin is positioned so as to limit travel of said slam bolt at a predetermined point relative to said housing.

22. Methodology as in claim 17, wherein the mating end of such housing comprises a generally rectangular shaped element complementary in shape to a generally rectangular matable driving element of the associated lock, for engaging same.

23. Methodology as in claim 22, wherein the securing step includes selectively positioning such housing relative to the matable driving element of the associated lock, so that the slam bolt is selectively positioned relative to the associated enclosure.

24. Methodology as in claim 17, further including adding a spacer element of predetermined thickness, positioned between the housing mating end and the driving element of the associated lock, for selectively positioning such slam bolt relative to an associated enclosure.

25. Methodology as in claim 17, wherein the associated lock comprises one of a keyed lock and a keyless lock using a handle for actuation.

26. Methodology as in claim 17, wherein the associated lock comprises one of a mechanical lock and an electromechanical lock.

* * * * *